US005442983A

United States Patent [19]

D'Angelo et al.

[11] Patent Number: 5,442,983

[45] Date of Patent: Aug. 22, 1995

[54] ALL-ELECTRIC WEB FEEDING, CUTTING AND SHEET DISPENSING MACHINE

[76] Inventors: Joseph J. D'Angelo, 378 Annette Ct., Wycoff, N.J. 07481; Joseph J. D'Angelo, Jr., 2 Summit Ave., Pompton Lakes, N.J. 07442

[21] Appl. No.: 129,669

[22] Filed: Sep. 30, 1993

[51] Int. Cl.[6] ..... B26D 5/42; B26D 7/02

[52] U.S. Cl. ..... 83/56; 83/208; 83/282; 83/455; 83/578; 83/614; 83/650

[58] Field of Search ..... 83/56, 208, 209, 210, 83/282, 455, 578, 614, 649, 650

[56] References Cited

U.S. PATENT DOCUMENTS

| | | | |
|---|---|---|---|
| 3,301,117 | 1/1967 | Spaulding | 83/614 X |
| 3,614,854 | 2/1972 | Keesling | 83/614 X |
| 3,635,113 | 1/1972 | Kramer | 83/614 X |
| 3,760,669 | 9/1973 | Rosenthal et al. | 83/208 X |
| 3,823,635 | 7/1974 | Carlson | 83/455 X |
| 3,986,419 | 10/1976 | Cleghorn | 83/455 X |
| 4,117,753 | 10/1978 | Friddle, Sr. et al. | 83/614 X |
| 4,257,295 | 3/1981 | Patel | 83/282 X |
| 4,354,408 | 10/1982 | Carte | 83/208 X |
| 5,107,734 | 4/1992 | Armbruster | 83/614 X |
| 5,243,890 | 9/1993 | Ober | 83/614 X |

*Primary Examiner*—Eugenia Jones
*Attorney, Agent, or Firm*—G. Kendall Parmelee; Parmelee, Bollinger & Bramblett

[57] ABSTRACT

An all-electric web feeding, cutting and sheet dispensing machine includes a bi-directional cutting knife on a reversible carriage driven by a reversible-rotation knife-drive shaft. The carriage includes a ball-bearing-wheeled linear actuator riding on the knife-drive shaft propelling the carriage along this shaft in cutting strokes in one or the other direction as this shaft is rotated in one or the other sense of rotation for cutting sheets off from a web of resilient packaging material. A combined knife-guard and clamp jaw (guard/clamp) holds the web and protects the moving knife from contact with foreign objects while the knife is traveling during each cutting stroke. At the end of each cutting stroke a cam on the knife carriage lifts the guard/clamp in readiness for feeding another length of web. The machine may be set for various operating modes: (1) automatic supply on demand by feeding and cutting of measured lengths of web triggered by an operator's removal of each previously cut sheet; (2) semi-automatic for feed and cut in response to manual actuation of a switch; (3) timed operation feeding and cutting of sheets at pre-set intervals of time; (4) selectable feeding and cutting of either of two different widths and/or two different types and/or two different thicknesses of web material coming from upper or lower feed rolls. The knife includes two sharp replaceable blades removably mounted tip-to-tip in the knife carriage with their cutting edges inclined downwardly in opposite directions from those adjacent tips.

22 Claims, 11 Drawing Sheets

ALL-ELECTRIC WEB FEEDING, CUTTING AND SHEET DISPENSING MACHINE

FIELD OF THE INVENTION

The present invention is in the field of machines for feeding web material and for cutting the web stock into sheets being dispensed. More particularly this invention relates to all-electric machines for feeding, cutting and dispensing sheets of various types of packaging material, for example such as resilient foam material, kraft paper material, bubble plastic material, tissue paper material, etc. Such sheets of packaging material are suitable for protecting and/or resilient padding and packaging of various articles and products, as may be desired prior to their storage or shipment.

BACKGROUND

The following patents in the name of one or both of the present inventors relate to web feeding, cutting and dispensing machines whose installations are more complex than the described machines embodying the present invention, because the prior machines disclosed in these four patents all require pneumatic power in addition to electric power:

| U.S. Pat. No. | Issue Date | Inventors |
|---|---|---|
| 4,151,770 | May 1, 1979 | Joseph J. D'Angelo<br>Lawrence S. Maccherone |
| 4,207,667 | June 17, 1980 | Joseph J. D'Angelo<br>Lawrence S. Maccherone |
| 4,699,031 | Oct. 13, 1987 | Joseph J. D'Angelo<br>Joseph J. D'Angelo, Jr. |
| 5,020,403 | June 4, 1991 | Joseph J. D'Angelo<br>Joseph J. D'Angelo, Jr. |

The present invention provides machines performing web feeding, cutting and dispensing of cut sheets of packaging material. These machines are compact and their installations are less complex overall than prior machine installations, because the present machines are all-electric, self-contained operating units without requiring pneumatic power in addition to electric power. The need for compressed air is eliminated, thereby eliminating the floor space and the expense involved in compressor installations which usually include pressure tanks, compressed-air coolers, air lines, filters, valves and pneumatic connections. Furthermore, elimination of compressor installations avoids the noise associated with active compressors and their frequently operating drive motors.

Machines embodying the present invention utilize a travelling knife cut-off operation in distinction to a hot-wire cut-off operation. It has been found that use of a hot wire for cutting foam plastic sheets liberates fumes, vapor and/or smoke as the hot wire melts through plastic material along the length of a cut line. These fumes, vapor and/or smoke condense into deposits on nearby room-temperature components of hot-wire machines. Such deposits relatively rapidly build-up to significant thicknesses, thereby requiring "down time" for clean-up of the machines. Moreover, in certain cases, exhaust ducts and associated suction blowers and filters may be required to remove fumes, vapor and/or smoke from plant facilities wherein groups of hot-wire machines are in use.

SUMMARY

In all-electric web feeding, cutting and sheet dispensing machines embodying the present invention a web of resilient packaging material is fed from a roll of web stock. Such machines may include two rolls of web stock of different widths and/or of different types and/or different thicknesses. For cutting each sheet of measured length from a web stock, there is a reversible-direction cutting knife on a carriage driven by a rotatable knife-drive shaft which is rotatable about its axis in either rotational sense. The knife carriage includes a linear actuator which has ball-bearing units on the linear actuator with their axes of rotation angled in a helical pattern relative to the axis of the rotatable knife-drive shaft for causing the linear actuator to roll along the knife-drive shaft when this shaft is rotated. Thus, rotation of the knife-drive shaft in one rotational sense propels the cutting knife along this shaft in a cutting stroke in a first direction for cutting a sheet of measured length from the web stock. Subsequently, rotation of the knife-drive shaft in the opposite rotational sense propels the cutting knife along this shaft in another cutting stroke in the opposite direction from the first cutting stroke, and so forth with cutting strokes alternating in direction.

A combined knife-guard and clamp jaw holds the packaging material web stock and protects the moving knife from contact with any foreign object while the knife is travelling during each cutting stroke.

In order to lift the combined knife-guard and clamp jaw (guard/clamp) at the conclusion of each cutting stroke, there are sloping cam surfaces on the knife carriage engaging with cam follower lift wheels located near opposite ends of the guard/clamp for lifting the guard/clamp after completion of each cutting stroke in readiness for feeding another length of web stock.

Machines embodying the invention may be set for various operating modes: (1) Automatic feeding and cutting of measured lengths of the web may be provided, with each feeding and cutting cycle being triggered, i.e., being initiated, by an operator's removal from the machine of each previously cut sheet; for example a photo cell may sense removal of the previously cut sheet. Thus, automatic feeding and cutting is responding directly to the supply demands of an operator without putting the operator under stress to speed up. (2) Feeding and cutting may occur in response to an operator's actuation of a foot switch or a push button switch. (3) Pre-set time intervals may be used for timed delivery feeding and cutting of measured lengths of the web at predetermined time intervals. (4) Feeding and cutting of measured lengths of web may be provided from two rolls of web stock, an upper roll and a lower roll. The two webs may be of different widths and/or different types and/or different thicknesses, and the lengths of sheets to be cut from the two webs may be pre-set at different sizes. Manual control enables an operator to select from which web the next sheet is to be cut.

The knife includes two sharp replaceable blades of the type used in utility-type hand cutters. These blades are removably mounted in the knife carriage in tip-to-tip position with their cutting edges sloping downwardly in opposite directions from those adjacent tips.

Advantageously a machine embodying the present invention controls the movements of resilient foam packaging material so effectively that a static eliminator (which usually is employed to be included in machines handling such material) is not needed.

BRIEF DESCRIPTION OF THE DRAWINGS

The invention, together with further objects, features, advantages and aspects thereof, will be more clearly understood from the following detailed description considered in conjunction with the accompanying drawings in which the emphasis has been placed upon clearly illustrating the principles of the invention. Like reference numerals indicate like elements or like components throughout the different views.

The accompanying drawings, which are incorporated in and constitute a part of the specification, illustrate presently preferred embodiments of the invention and, together with the general description set forth above and the detailed description of the preferred embodiments set forth below, serve to explain the principles of the invention. In these drawings:

FIG. 3 shows two self-braking drive motors, whose positions are indicated in dashed outline in FIG. 2.

DETAILED DESCRIPTION OF PREFERRED EMBODIMENTS OF THE PRESENT INVENTION

Figure 1:
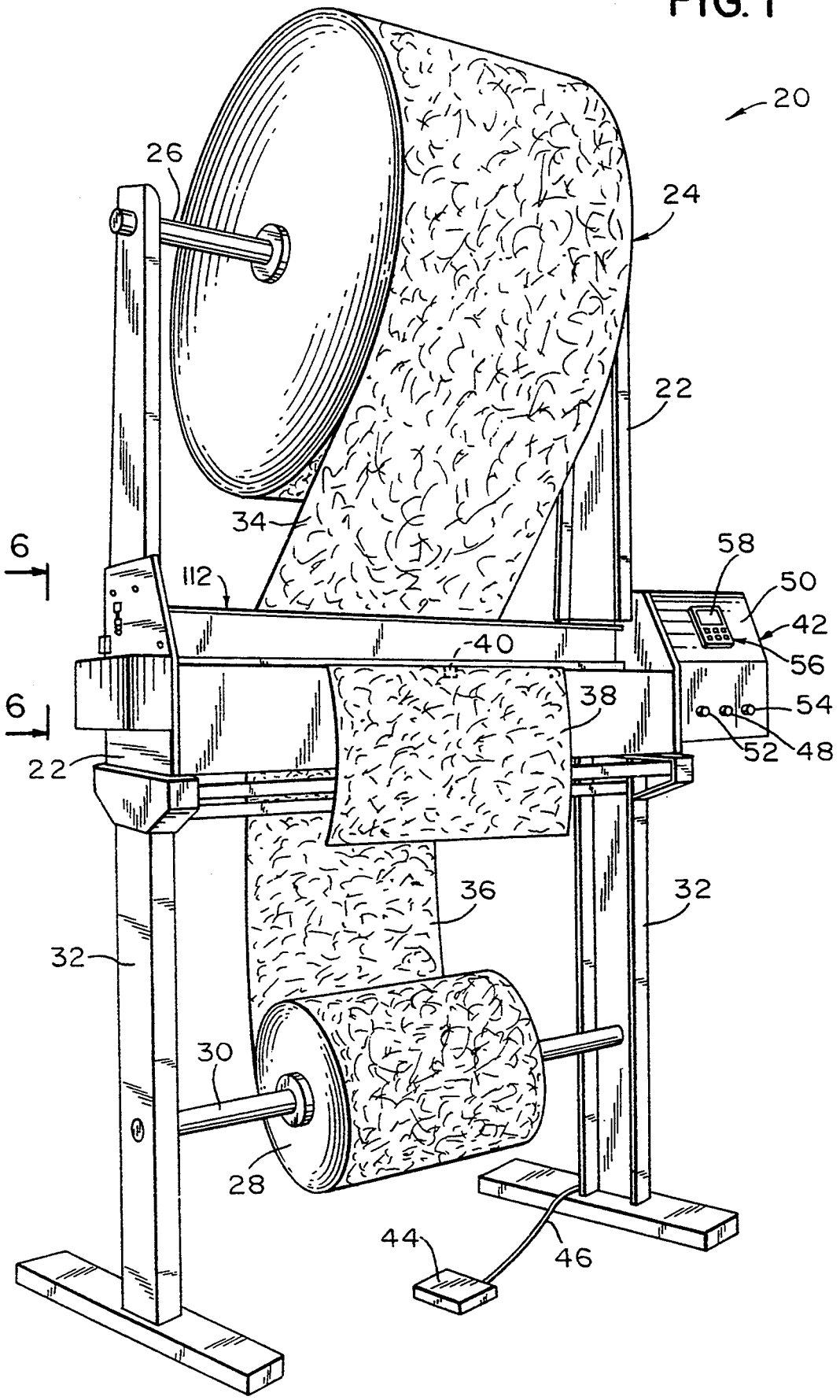
FIG. 1 is a perspective view looking at the front and left side of an all-electric web feeding, cutting and dispensing machine embodying the present invention.

As shown in FIG. 1, a web feeding, cutting and sheet dispensing machine 20 embodying the present invention comprises a frame 22 with a web stock source roll 24 of packaging material mounted for free rotation about a horizontal support shaft 26 located at the top of the machine frame. If desired, in another embodiment of the invention, a second web stock source roll 28 of packaging material may be mounted for free rotation about a second horizontal support shaft 30 extending between a pair of legs 32 of the machine frame 22. Alternatively, either support shaft 30 or 32 may be used for temporarily storing a roll of packaging material. These illustrative examples show rolls of resilient foam plastic padding and packaging material about one-eighth of an inch thick. It is noted that thinner or thicker foam plastic material readily can be handled in the same manner as the illustrative webs which are shown. For example, we believe this machine is capable of handling resilient foam packaging material up to one-half of an inch thick. Also, this machine is adapted to handle various other types of packaging material, for example such as kraft paper web material, bubble plastic web material and tissue paper web material. The web stock packaging material 36 supplied from the lower roll 28 may be of different width and/or different type and/or different thickness from the web stock material 34 supplied from the upper roll 24.

A cut sheet 38 is shown draped from the front of the machine 20 in convenient position for an operator to remove it. In one selectable mode of operation of the machine, a photocell 40 in the center front of the machine 10 positioned beneath a cut sheet 38 senses removal of each such cut sheet and then initiates feeding and cutting of a next sheet. In other words, the operator's supply demand is automatically being met by the machine without putting stress on the operator to speed up.

In another selectable mode of operation of the machine called "timed operation", a timer within a controller 42 mounted on the right side of machine 20 serves to feed a selected web 34 or 36 and to cut successive sheets 38 at predetermined time intervals. In a semi-automatic mode of operation involving direct control by an operator, the operator may initiate each feed and cut cycle by actuating a suitable switch. For example a foot switch 44 may be used connected by an electric cable 46 with the controller 42. As an alternative to a foot switch, the operator may press a push feed button 48 of a switch in the controller 42 for starting each feed and cut cycle.

Also provided on the control panel 50 of the controller 42 is a selection switch button 52 for turning the machine 20 OFF and for putting the machine into automatic or semi-automatic mode.

Figure 4:
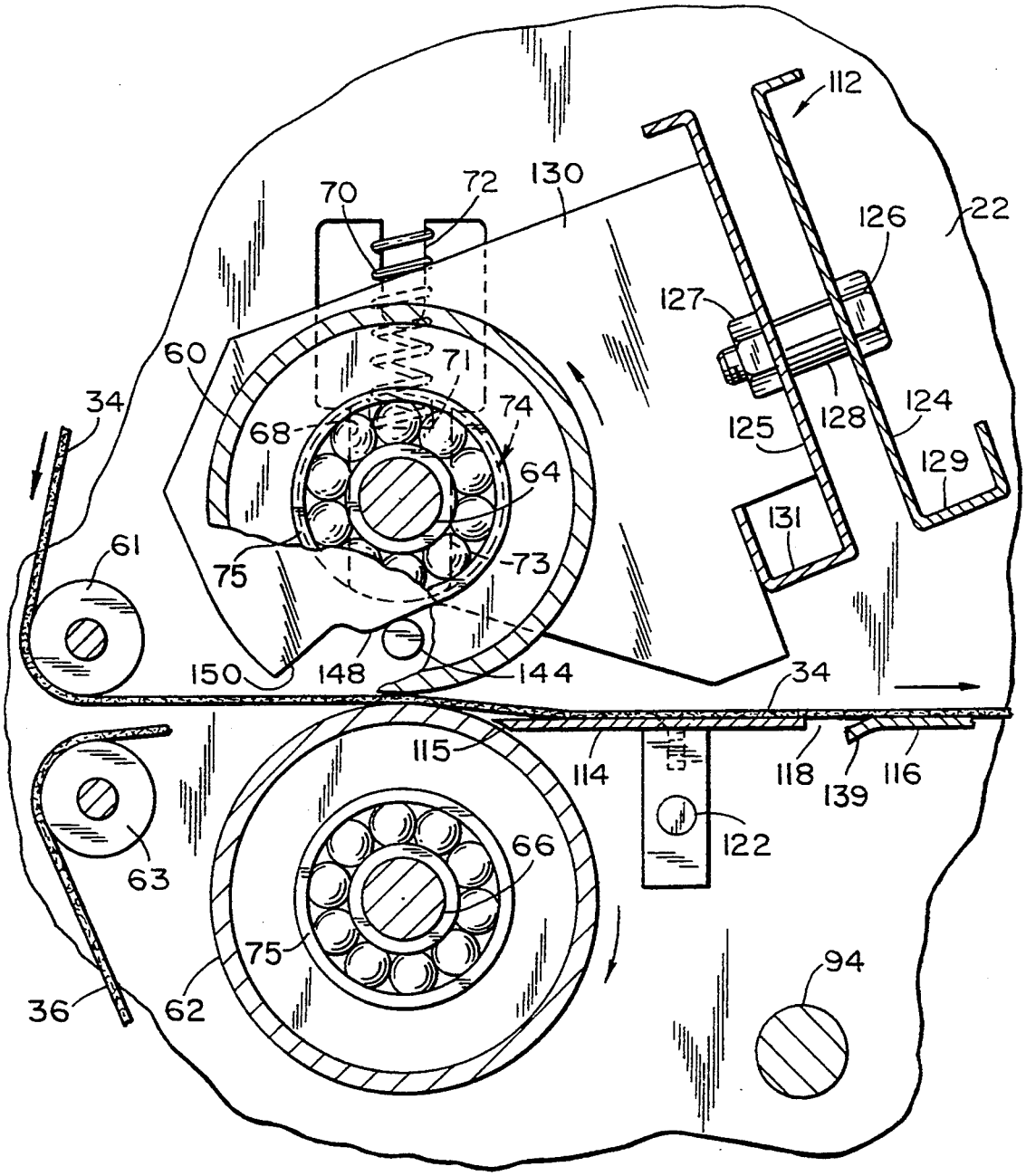
FIG. 4 is an enlarged cross-sectional view taken along the plane 4—4 in FIG. 3 showing two feed rollers feeding a web of resilient packaging material. The combined knife-guard and clamp jaw is shown in its lifted position as occurs to accommodate feeding of a web. The cut-off knife with its carriage is not seen in FIG. 4, because it is momentarily positioned at a remote end of its cutting stroke, which is away from the section view location shown in FIG. 4.
Figure 9:
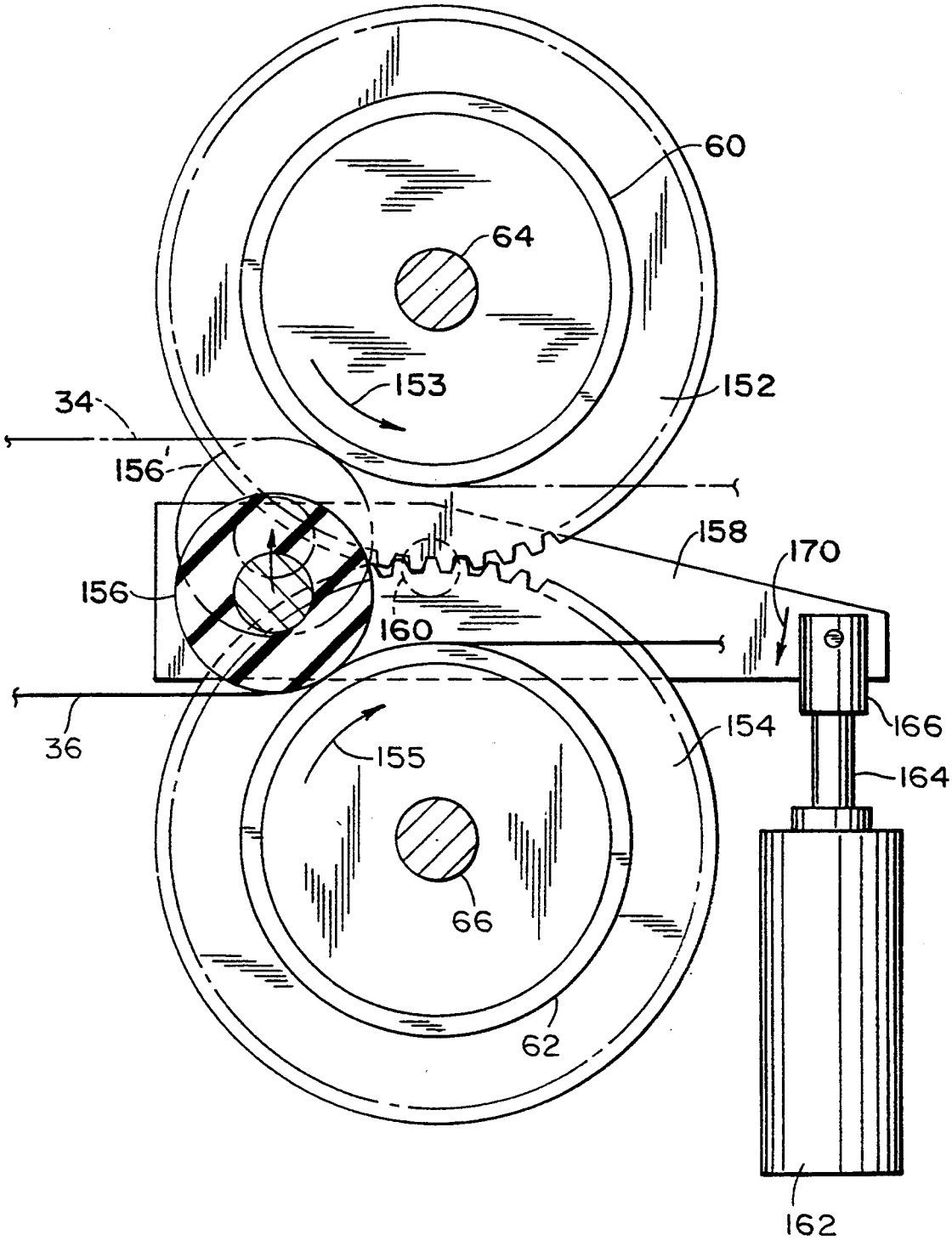
FIG. 9 is a partial sectional view similar to FIGS. 4 and 5 illustrating a second embodiment of the invention wherein web stock is selectably feedable from an upper or lower supply roll.

In machines which are equipped as shown in FIG. 9 for feeding and cutting either an upper web 34 or a lower web 36, the machine may be arranged for a normal operating mode "A" in which the machine 20 feeds and cuts only a pre-selected web 34 or 36 as the operator's choice may be. For example, in operating mode "A" the machine may be arranged to feed and cut only upper web 34 as shown in FIG. 4 or only lower web 36 as shown in FIG. 9. Pressing a "B"-mode button 54 prior to a next operating cycle causes the machine to change into operating mode "B" in which the alternate web is fed and cut. Releasing the push button 54 allows the machine automatically to return to its normal "A"-mode of operation. Turning the push button 54 to alternative positions provides for feeding various pre-set lengths of packaging material for providing cut sheets of various desired lengths for example eighteen inches or fourteen inches.

In order to pre-set desired count values in a counter for pre-determining desired measured lengths of the respective web 34 or 36 to be fed, there is a key pad 56 on the control panel 50. This key pad includes a plurality of depressible keys as shown, and it has a read-out screen 58 for displaying the numerical values being entered. For example, these numerical values may represent inches desired for the lengths of respective sheets to be fed and then cut from either the web 34 or 36 or two different selectable lengths to be fed and cut from the same web. These respective lengths may be different, for example such as eighteen inches for sheets 38 fed and cut from the upper web 34 and fourteen inches for sheets 38 fed and cut from the lower web 36 or for eighteen or fourteen inches for sheets cut from the same web.

Figure 1A:
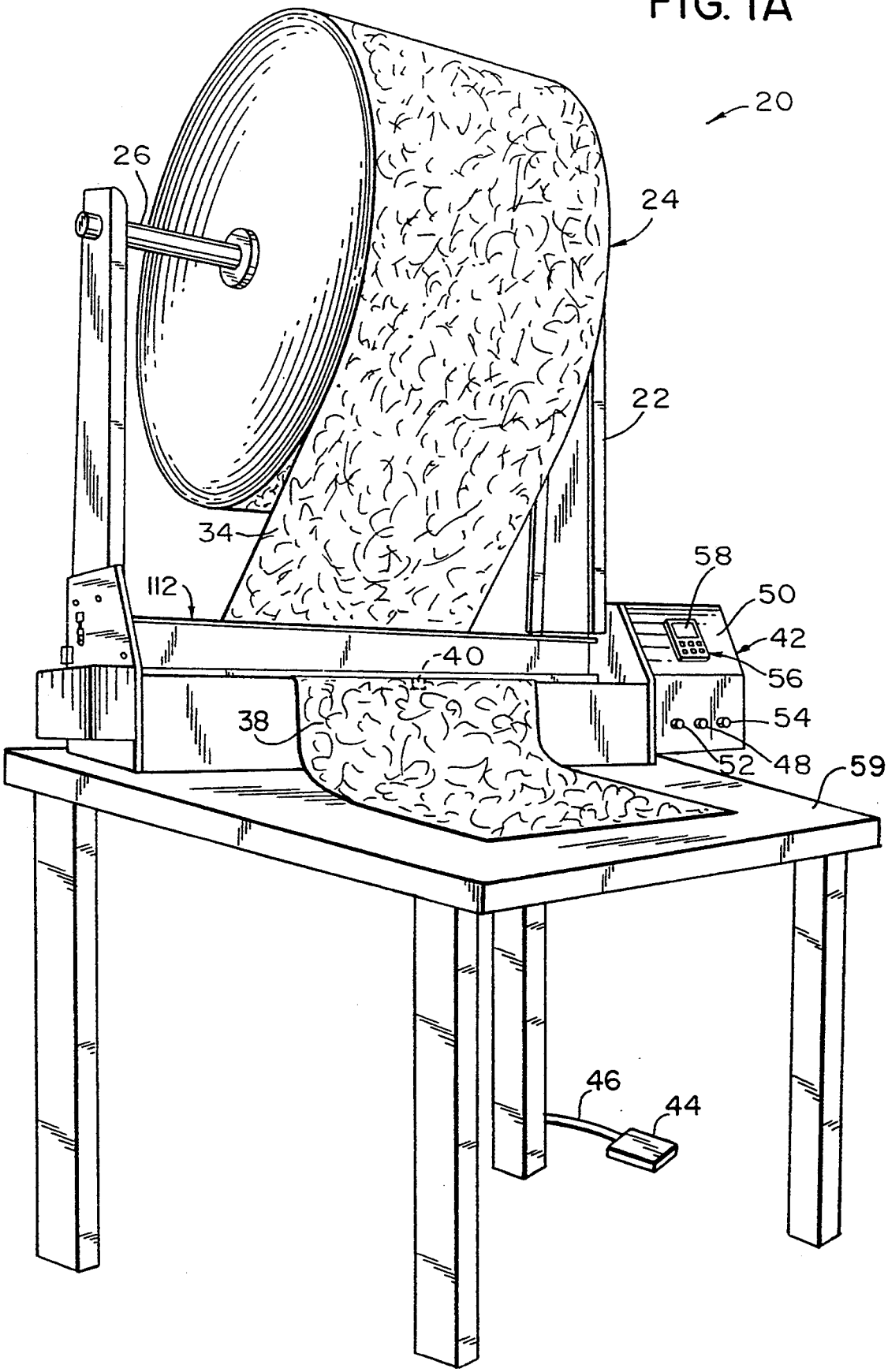
FIG. 1A shows the machine of FIG. 1 mounted on a work table or work bench.

FIG. 1A shows the machine 20 mounted on a work table or work bench 59. The legs 32 (FIG. 1) are removable, and the lower surface of the frame 22 is arranged for seating directly onto a work table without using machine legs 22. It is among the further advantages of the present machine 20 that it is adaptable conveniently for leg-mounting or for table-mounting. In FIG. 1A the front portion of a cut sheet 38 is shown resting upon the work table 59 in readiness to be picked up by an operator.

Figure 2:
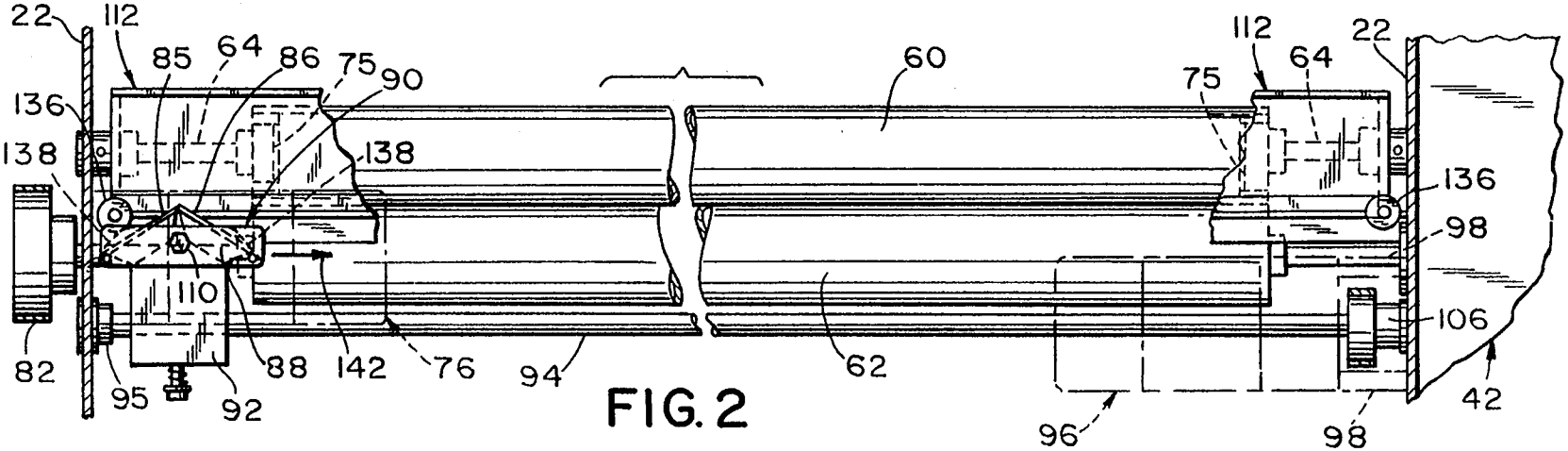
FIG. 2 is a partial front elevational view as seen from the plane 2—2 in FIG. 3, showing particularly the reversible travelling cut-off knife, its carriage including a linear actuator, knife-drive shaft and two feed rollers. Portions of the combined knife guard and clamp jaw (guard/clamp) are also seen.
Figure 3:
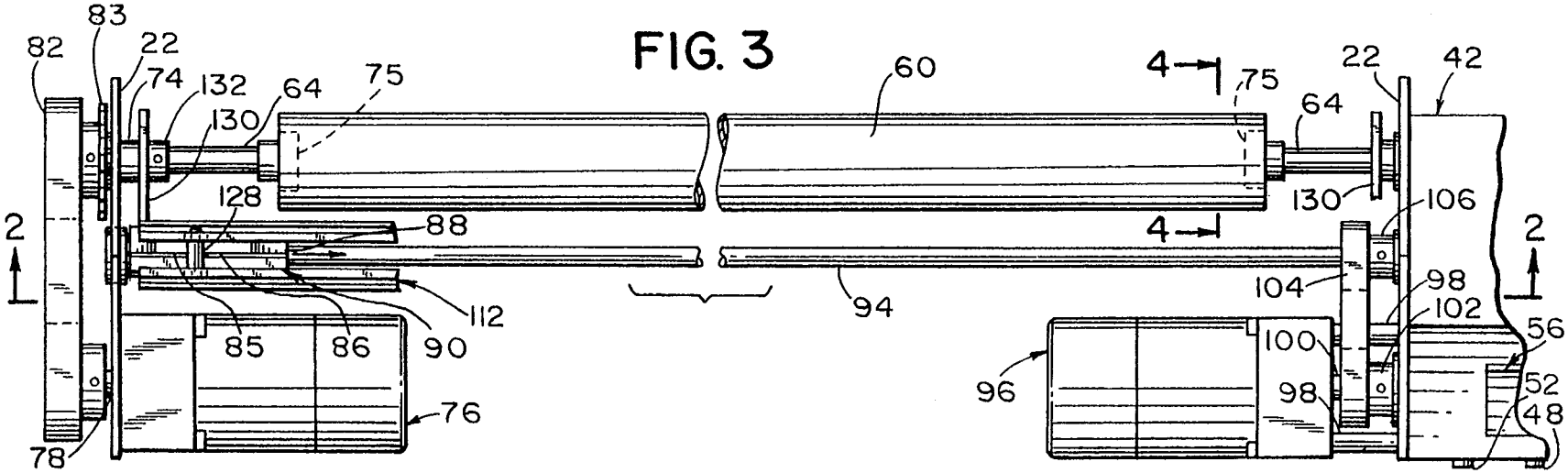
FIG. 3 is a top plan view of the components of the machine seen in FIG. 2. Also.
Figure 6:
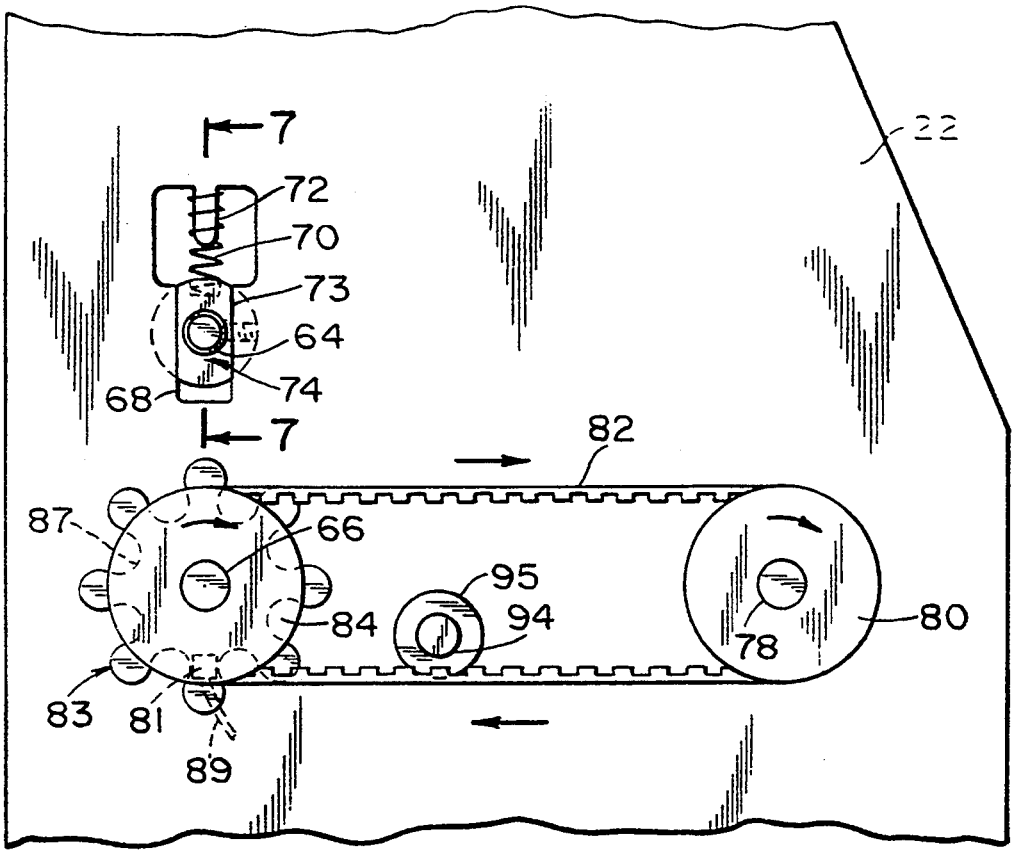
FIG. 6 is an enlarged partial elevational view of the left side of the machine in the region 6—6 in FIG. 1 (with a protective cover removed) for showing a belt drive for the lower feed roller and also showing spring-loading for providing downward force on the axle of the upper feed roller.
Figure 7:
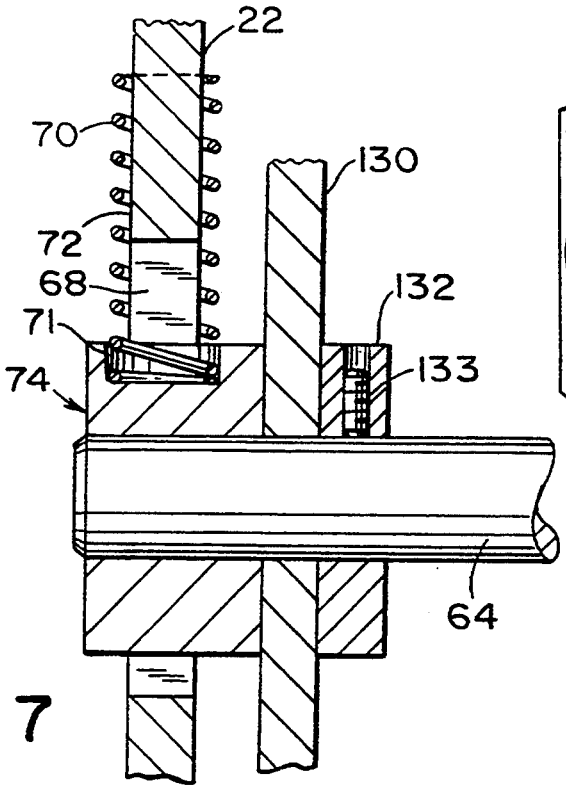
FIG. 7 is a further enlarged partial sectional view as seen along the plane 7—7 in FIG. 6 showing downward spring-loading on the upper feed roller axle.
Figure 7A:
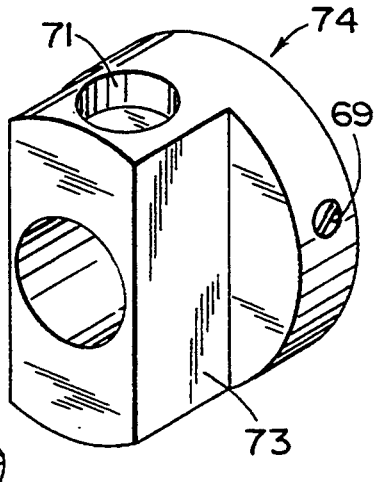
FIG. 7A is an enlarged perspective view of an axle mounting member, which is seen also in FIG. 7.

As shown in FIGS. 2 and 4, in a machine 20 in which a pre-selected web is to be fed and cut, for example such as the upper web 34, there are adjacent upper and lower feed rollers 60 and 62 mounted on axles 64 and 66, respectively. These feed rollers normally press in the nip region against upper and lower surfaces of the web 34 being fed. For example, to exert a downward force on upper roller 60, each end of its axle 64 as shown in FIGS. 6 and 7 may be mounted in a holder 74 (FIG. 7A) slidable up and down in a vertical slot 68 in the machine frame 22. A compression spring 70 captured on a stud 72 presses down on the vertically movable axle holder 74 which is fastened on the axle 64 by a screw 69. The lower end of the spring 70 seats in a socket 71 on the axle holder 74, thereby creating a down force on the upper feed roller 60 for providing a nip gripping action between the upper and lower feed rollers 60 and 62. As shown in FIG. 4, the upper web 34 travels partially around an idler guide roller 61 leading into the nip region between feed rollers 60 and 62. Similarly, as will be understood from FIG. 4, the lower web 36 may travel partially around another idler guide roller 63 leading toward the nip region between the feed rollers.

In the machine arrangement shown in FIGS. 2 through 8, the upper feed roller 60 is mounted by bearings 75 (FIGS. 4, 5 and 8) for free rotation about its axle 64, and only the lower feed roller 62 is driven by a self-braking alternating current (AC) drive motor 76 (FIG. 3) mounted on the machine frame 22. This motor 76 has a drive shaft 78 (FIG. 6) turning a cog pulley 80 (FIG. 6) connected by a cogged belt 82 to a second cog pulley 84 which is driven by this belt and which is secured to and turns with the rotatable axle 66 of the lower feed roller 62 for turning this lower roller.

A presently preferred arrangement for machines 20 for measuring desired lengths of a sheet 38 to be cut is to provide feed rollers 60 and 62 each having a hardened surface which is appropriately plated, for example zinc plated, and having a diameter of about 2.5 inches, thus having a draw surface circumference of about 7.9 inches. Consequently, one-eighth of a rotation of the feed roller 62 will provide a cut sheet length nominally of about one inch (assuming no feed roll slippage relative to the web) which in actuality is quite close to a measured length of one inch for sheets 38 intended to be used for packaging purposes. In other words, each one-eighth of a rotation, i.e., each 45° of rotation, provides about one inch of measured length of a web to be cut. A proximity sensor 81 (FIG. 6) mounted on frame 22 adjacent to a rotatable eight-lobed disc (or "star wheel") 83 fastened to axle 66 responds to eight lobes and valleys 87 on this disc angularly spaced apart 45° so that the sensor 81 provides a pulse signal corresponding to each lobe representing one-inch feeding of a web to be cut. This proximity sensor 81 is connected by an electrical cable 89 to a pre-settable pulse counter in the controller 42 for measuring the length of each sheet to be cut.

An alternative way to measure lengths of the web being fed to be cut is to use a suitable web-feed drive motor 76 (FIG. 3) in which angular positioning of the motor shaft 78 is encoded. The encoded data regarding positions of motor shaft 78 are provided for controller 42. As seen in FIG. 6, drive and driven cog pulley wheels 80 and 84, respectively, have equal diameter., and cogged belt 82 prevents slippage. Thus, rotation of motor shaft 78 exactly corresponds with rotation of lower feed roller 62 so that each 45° turn of motor shaft 78 corresponds to nominal feed of one inch of web.

Figure 5:
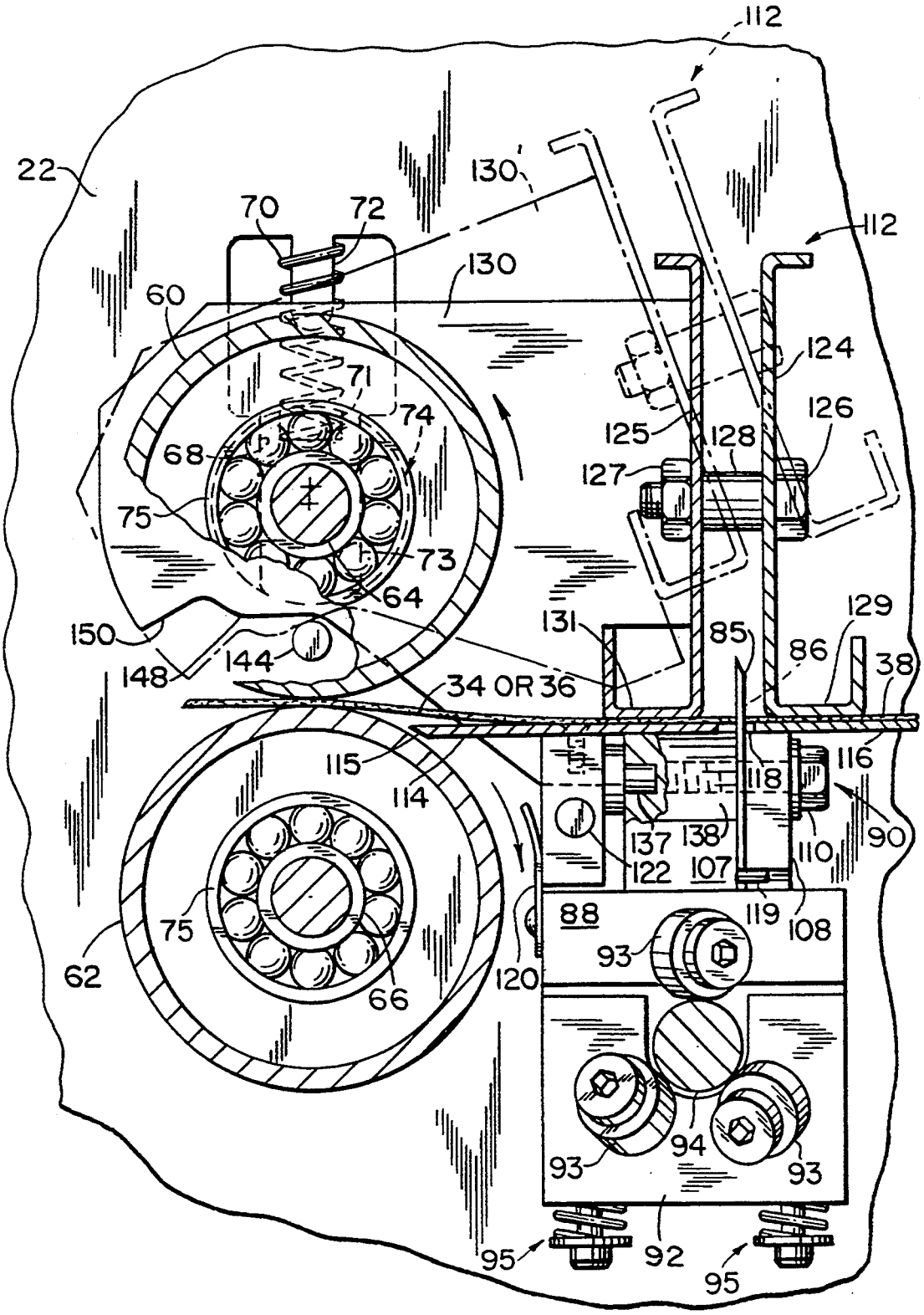
FIG. 5 is a cross-sectional view similar to FIG. 4, except that the cut-off knife carriage is shown moving in its cut-off stroke with the combined knife guard and clamp jaw in its down position for clamping the web being cut.
Figure 10:
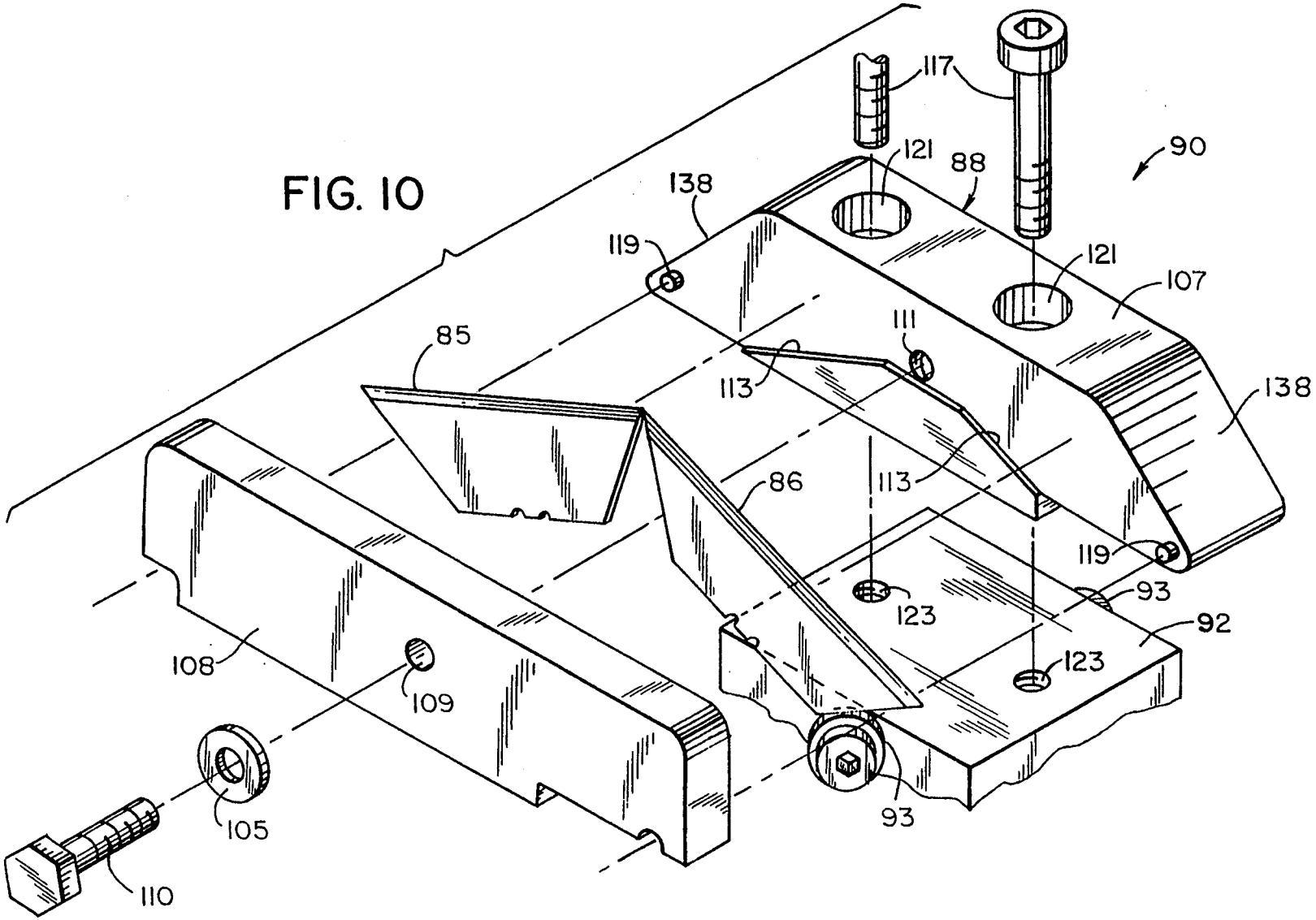
FIG. 10 is an exploded perspective view of the knife carriage assembly with its two cutter blades mounted tip-to-tip. This FIG. 10 also shows a top portion of the linear actuator which propels the knife carriage in its cutting stroke.

To cut off each sheet 38 (FIG. 1 or 1A) from a web of packaging material, there is a bi-directional, reversible-motion cutting knife assembly 90 (FIG. 2) including a pair of tip-to-tip oppositely sloping blades 85 and 86 removably secured in a carriage 88 (see also FIGS. 5 and 10). This knife carriage 88 includes a linear actuator 92 riding on a rotatable knife-drive shaft 94. This linear actuator 92 has six ball-bearing wheel units 93 mounted on it (three on each end as seen in FIG. 5) being resiliently biased into frictional rolling relationship with shaft 94 by manually adjustable resilient means 95 including machine screws and springs. The axes of rotation of these wheel units 93 are angled in a helical pattern for causing the linear actuator to roll along the knife-drive shaft 94 when this shaft is rotated. Thus, rotating this shaft 94 in one rotational sense propels the cutting knife assembly 90 along it in a first traverse in one direction for cutting a sheet 38 (FIG. 1) of measured length from the web 34. Subsequently, rotation of this shaft 94 in the opposite rotational sense propels the cutting knife assembly 90 along it in another traverse in the opposite direction from the first traverse. Thus, cutting strokes alternate in direction.

An advantage of using this frictionally driven linear actuator with helically-angled ball-bearing wheel units 93 riding on a smooth, hardened surface of a rotatable shaft 94, as compared with positive drive mechanism, is that such linear actuator 92 will slip relative to shaft 94 if an unyielding foreign object gets in the way of the knife assembly 90 during a traverse. Thus, machine 20 will not become damaged by inadvertent intrusion of such an object in front of the traversing knife carriage 88. Conversely, a lead-screw drive mechanism would produce positive drive action which could cause damage to such a machine upon intrusion of an unyielding object in front of a traversing knife carriage. A helically-angled ball-bearing wheel linear actuator 92 is available commercially from Zero Max located at 2845 Harriet Avenue South, Minneapolis, Minn. 55408 and is identified as a "Roh'lix" (Reg. TM) Linear Actuator. As a suitable example, it is noted that the diameter of knife-drive shaft 94 and the feed rate of the linear actuator 92 may be arranged so that each 360° rotation of the shaft 94 produces one inch of advance of the knife assembly 90. For example, a one-half inch diameter shaft 94 and a Roh'lix Linear Actuator - Size 2 - Model 2112 will produce one inch of knife carriage advance per revolution of the shaft 94.

For rotating the knife-drive shaft 94 there is a self-braking, reversible AC drive motor 96 (FIG. 3) mounted on stand-off posts 98 on the machine frame 22 near the controller 42. This motor has a drive shaft 100 turning a cog pulley 102 connected by a cogged belt 104 to another cog pulley 106 which is driven by this belt and is fastened to the knife-drive shaft for turning this shaft.

For removably mounting blades 85 and 86 in the carriage 88, each blade is sandwiched, as is shown in FIG. 10, between a rear member 107 of the carriage 88 and a front clamp plate 108 removably attached to the rear member by a machine screw 110 passing through a hole 109 and engageable in a tapped hole 111. A washer 105 is shown for screw 110. These blades 85 and 86 may be any sharp-edged hardened blades, for example such as the removable, replaceable blades used in utility knives. As shown in FIG. 10, the blades are mounted tip-to-tip with the left blade 85 sloping downwardly from its tip toward the left for cutting web material during a left-travel cutting stroke and with the right blade 86 sloping downwardly from its tip toward the right for cutting web material during a right-travel cutting stroke. It is seen in FIG. 10 that the cutting edges of the two blades 85 and 86 slope downwardly from a vertex defined at their adjacent tips, i.e., they slope in the respective directions of two downwardly sloping sides of an isosceles triangle positioned with an upright vertex. The downward slope of each cutting edge is in a range from about 25° to about 35°, for example a presently preferred slope for these blades 85, 86 is about 30° relative to stroke direction.

The rear member 107 (FIG. 10) is about $4\frac{1}{4}$ inches long and has two upwardly-sloping blade-supporting and aligning shoulders 113 with a pair of blade-locator pin stops 119 mounted in opposite ends of the rear member 107. The shoulders 113 project forward from the rear member 107 for example about 0.020 of an inch, which is slightly less than the thickness of the utility cutter blades 85, 86 so that the front clamp plate 108 will forcefully clamp against the blades for holding them securely in place. Suitable blades 85, 86 are "Heavy Duty" Utility Blades 0.025 of an inch thick available commercially from Ardell Industries, Inc. whose address is 555 Lehigh Avenue, Union, N.J. 07083. A pair of socket-head machine screws 117 pass through holes 121 in the rear carriage member 107 and engage in tapped sockets 123 in the linear actuator 92 for fastening the member 107 to the linear actuator.

By virtue of the fact that the cutting edge of each blade is sloping there is a slight upward component of thrust being exerted on the web as it is being cut. For resisting this upward thrust and for clamping a web firmly in its place while it is being cut (FIG. 4), there is a combined knife guard and clamp jaw 112 (guard/clamp) which clamps the web down against a stationary horizontal stripper plate 114 and a stationary horizontal front plate 116 parallel with and aligned with the stripper plate. The stripper plate 114 has a stripper edge 115 positioned close to the surface of the lower feed roller 62 for assuring that a web 34 or 36 being fed through the nip between feed rollers 60 and 62 does not cling to the surface of the lower feed roller. The front plate 116 may have a downturned edge 139 (FIG. 4) and/or may be slightly lower than the stripper plate 114 so that a leading edge of a web 34 or 36 will advance neatly over this front plate.

The knife blades 85 and 86 project up as shown in FIG. 5 through a relatively narrow gap 118 between plates 114 and 116. This gap 118 is located above and is parallel with the knife-drive shaft 94.

In order to prevent the linear actuator 92 from rotating with the rotatable shaft 94, there is a guide element 120 mounted on the linear actuator. This guide element 120 is shown as a tempered bronze leaf spring which is resiliently biased toward a guide rail 122 and is slidable longitudinally along the guide rail. The rail 122 is fastened stationary to the machine frame 22 and extends parallel with the knife-drive shaft. On the opposite side of the guide rail 122 from the guide element 120 is a second slidable guide element 137 (FIG. 5) for sliding along the guide rail 122. This second guide element 137 is shown as a slippery plastic button, for example of Nylon, seated in a hole in member 107.

Figure 8:
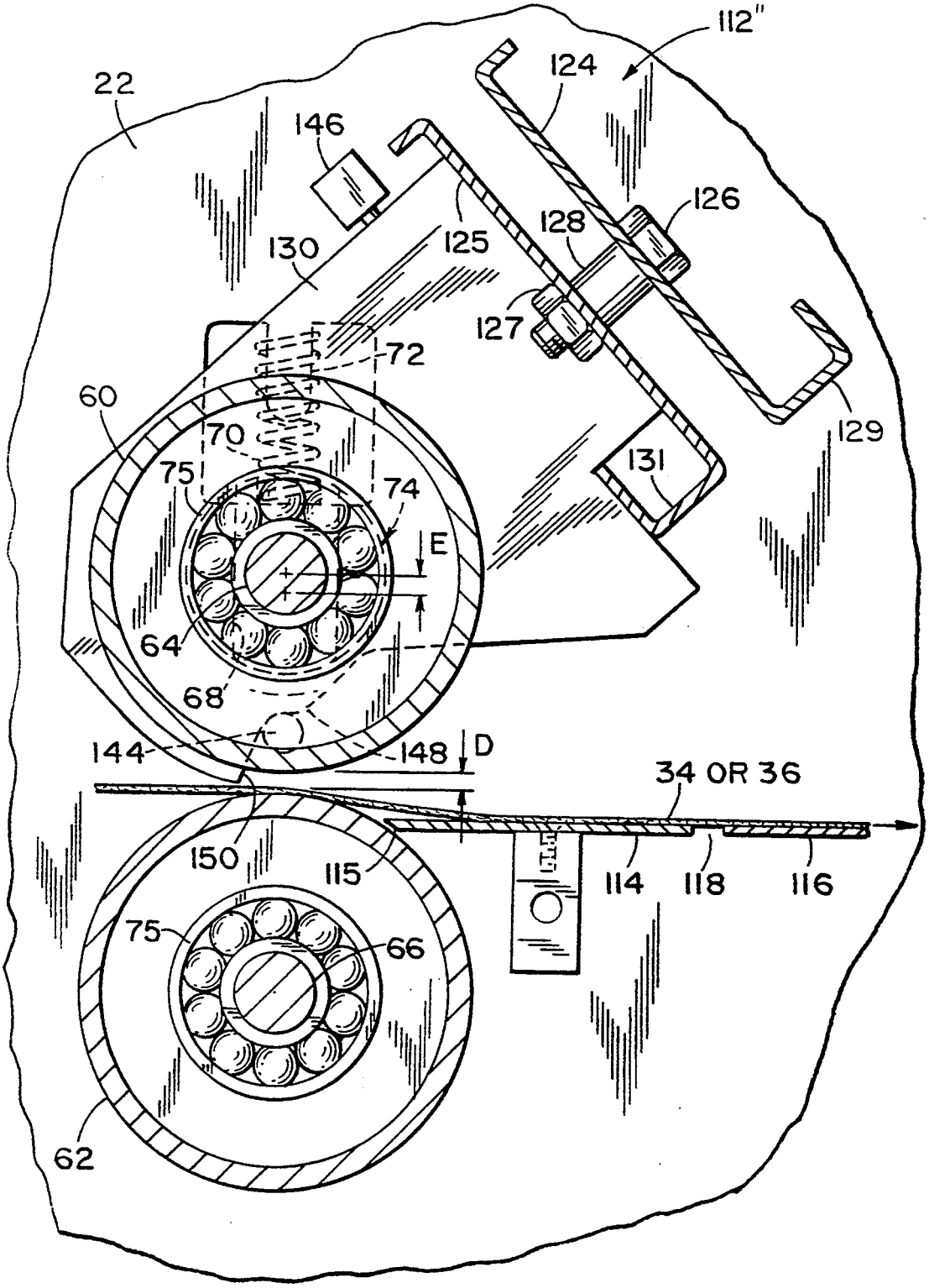
FIG. 8 is a view similar to FIGS. 4 and 5, showing how the upper feed roller is raised for facilitating loading a web of packaging material into a machine or for removing such a web for inserting a replacement web of a different type of packaging material.

The combined knife guard and clamp jaw 112 comprises a pair of spaced, parallel guard/clamp members 124, 125 (FIGS. 4, 5 and 8) secured in spaced relationship by bolts and nuts with a spacer sleeve 128 encircling each bolt shank between these members 124, 125. FIGS. 4, 5 and 8 show such a bolt 126, nut 127 and spacer sleeve 128. These spaced parallel clamp members 124, 125 have horizontal parallel flat bottom clamp jaw areas 129, 131 which are positioned respectively over the front plate 116 and over the stripper plate 114 for firmly clamping and holding the web 34 or 36 down upon these plates during cutting of the web.

The guard/clamp 112 is sufficiently stiff so as to keep its two support arms 130 aligned and parallel with each other. If effect, this guard/clamp 112 with its twin mirror-image, spaced members 124, 125 having upper and lower out-turned flanges is analogous to a rigid I-beam structure, as seen most clearly in FIGS. 4 and 5. The spacing between the guard/clamp members 124, 125 must be sufficient and their positioning relative to the knife blades 85/86 must be such that the guard/clamp 112 can swing down from its elevated position 112' (FIG. 5) to its guarding and clamping position 112 (FIG. 5) with suitable clearance for avoiding striking the knife blades, as will be understood from a consideration of geometric relationships shown in FIG. 5.

At its opposite ends the guard/clamp 112 is secured to the front ends of a pair of support lever arms 130 (FIGS. 2, 3, 4, 5 and 8) pivotally mounted on the axle 64 of the upper feed roller 60. These pivotally mounted lever arms 130 are positioned near to the respective'-sides of the frame 22 of the machine 20 as seen most clearly in FIG. 3. For positioning the left lever arm 130, so as to keep the guard/clamp 112 from shifting its position endwise, a collar 132 (FIG. 7) is mounted on the axle 64 adjacent to the opposite side of the left lever arm 130 from the axle-holder 74, and this collar 132 is held in place on the axle by a set screw 133.

In order to raise the guard/clamp 112 to an elevated position as shown in FIG. 4 after the knife assembly 90 has completed its cutting stroke so that the web 34 or 36, as the case may be, can be fed forward, there are two cam-follower wheels 136 (FIG. 2) respectively mounted at opposite ends of the clamp/guard. These cam-follower wheels are aligned with respective upwardly sloping ramp cam surfaces 138 (FIGS. 2, 5 and 10) formed on opposite ends of the rear member 107 of the carriage 88. As the carriage 88 nears the end of each cutting stroke, after completion of a cut across the full width of web 34 or 36, one of the cam-follower wheels 136 rides upwardly on the approaching ramp cam surface 138, which slopes upwardly at about 45° above horizontal, thereby raising the guard/clamp 112 and its support arms 130 to their elevated position as shown in FIG. 4 and shown in dashed outline in FIG. 5 at 112' and 130'.

In FIG. 2 soon after the cutting knife assembly 90 begins moving toward the right in a cutting stroke indicated by an arrow 142, the left ramp cam 138 becomes withdrawn from beneath the left cam-follower wheel 136, thereby allowing the guard/clamp 112 to become lowered into its web-clamping position as shown in FIG. 5. The weight of this guard/clamp 112 is sufficient for providing a desired clamping and holding force on the packaging material without employing any additional clamping-force augmentation during cutting. Even though the guard/clamp 112 is raised by a ramp cam 138 (FIG. 10) engaging a cam-follower wheel 136 (FIG. 2) during the conclusion of each cutting stroke, we have found that a cut sheet 38 of resilient foam material does not fall off of the front plate 116. When heavier packaging material is cut into sheets, the cut sheets may be held in place if desired by a solenoid-operated clamp of appropriate size energized into clamping position prior to raising of the guard/clamp 112. Such a solenoid-operated clamp is deenergized and is spring-retracted upon removal by the operator of a cut sheet.

A cutting stroke, such as the right-travel stroke 142 in FIG. 2 automatically commences as soon as a predetermined measured length of web has been fed as shown in FIG. 4. In other words, the controller 42 automatically activates the knife drive motor 96 (FIGS. 2 and 3) to cause it to turn in an appropriate direction for traversing the cutting knife carriage 90 as soon as a pre-set length-measurement count has been reached. As explained above, commencement of a cutting stroke allows the guard/clamp 112 to clamp down onto the web so that the cutting operation then can proceed as shown in FIG. 5. The knife-drive motor 96 is arranged to run for a predetermined time interval, for example three seconds, to produce a full cutting stroke. A timer in the controller 42 allows the motor 96 to run for such a predetermined time interval during each cutting stroke. Such timing is sufficient for the knife assembly 90 to travel the full length of the rotatable shaft 94.

When it is desired to remove and replace a web 34 or 36, with different packaging material or when a supply roll 24 or 28 has become exhausted and needs to be replaced, the operator manually swings the guard/-clamp 112 upwardly into a more fully elevated position as is shown at 112" in FIG. 8. This fully elevated position of the guard/clamp is the loading and unloading status for the machine. A safety switch 146 (FIG. 8) is responsive to the fully elevated position of one of the lever arms 130 and serves automatically to deactivate the machine so that the knife carriage cannot be driven so long as the guard/clamp is at the elevated position 112" (FIG. 8).

In order to raise upper feed roller 60 a small distance "D" (FIG. 8) for providing clearance, such as $\frac{3}{8}$ of an inch, in the nip region between feed rollers 60 and 62 for facilitating insertion of a web of packaging material or for allowing withdrawal of a web of material which is to be replaced, there is a fixed pin 144 projecting inward from each side of the machine frame 22. As shown in FIG. 8, each such pin 144 projects beneath a respective one of the lever arms 130. Each lever arm 130 has an arcuate lift-cam surface 148 terminating in a stop shoulder 150. This lift cam surface 148 rides up onto the pin 144 thereby raising the axle 64 by a distance "E" against the force of spring 70 for producing the nip clearance "D".

In order selectively to feed and cut either web 34 or 36, another embodiment of machine 20 is shown in FIG. 9 in which the feed rollers 60 and 62 are mounted in spaced relationship, for example being spaced about one inch apart. Each feed roller 60 and 62 may have a diameter of about 2.5 inches, as described previously. The axles 64 and 66 of both of these rollers are rotatably mounted by bearings (not shown) seated in opposite sides of the machine frame. A pair of meshing gears 152, 154 of equal diameter are fastened on the respective axles 64 and 66 so that the upper feed roller 60 is positively driven by these meshing gears 152, 154 as is shown by an arrow 153 in FIG. 9. The axle 66 of the lower feed roller is positively driven as shown by an arrow 155 by the motor 76 (FIG. 3) via the cog pulley wheels 80 and 84 (FIG. 6) with their interconnecting cogged belt 82.

An idler roller 156 having a resilient surface, for example being rubber-covered, is rotatably mounted on the rear ends of a pair of control arms 158 (only one such arm is seen in FIG. 9). This roller 156 extends across the width of the machine between these arms 158 and is located between the two webs 34 and 36. The respective control arms 158 are pivotally mounted by respective pivot bearings 160 (only one is seen) to a respective side of the machine frame. In this embodiment as is shown in FIG. 9, the "A"-mode of operation produces feeding of the lower web 36 because the idler roller 156 normally presses the lower web 36 against the draw surface of rotatable lower feed roller 62. There is a pull-down solenoid 162 having its actuating rod 164 pivotally connected by a clevis 166 to the front end of each control arm 158. A spring within the solenoid housing normally biases upwardly the front end of the control arm. Pressing the button 54 produces "B"-mode of operation by energizing the pull-down solenoid 162, thereby pulling the actuator rod 164 downwardly for swinging each control arm 158 around its pivot 160, as is shown by an arrow 170, for moving the idler roller 156 upwardly to its B-mode position 156' for pressing the upper web 34 against the draw surface of rotatable feed roller 60 for feeding the upper web. A suitable diameter for the idler roller 156 is about one-half of the diameter of a feed roller, for example thus being about 1.25 inches.

Figure 11A:
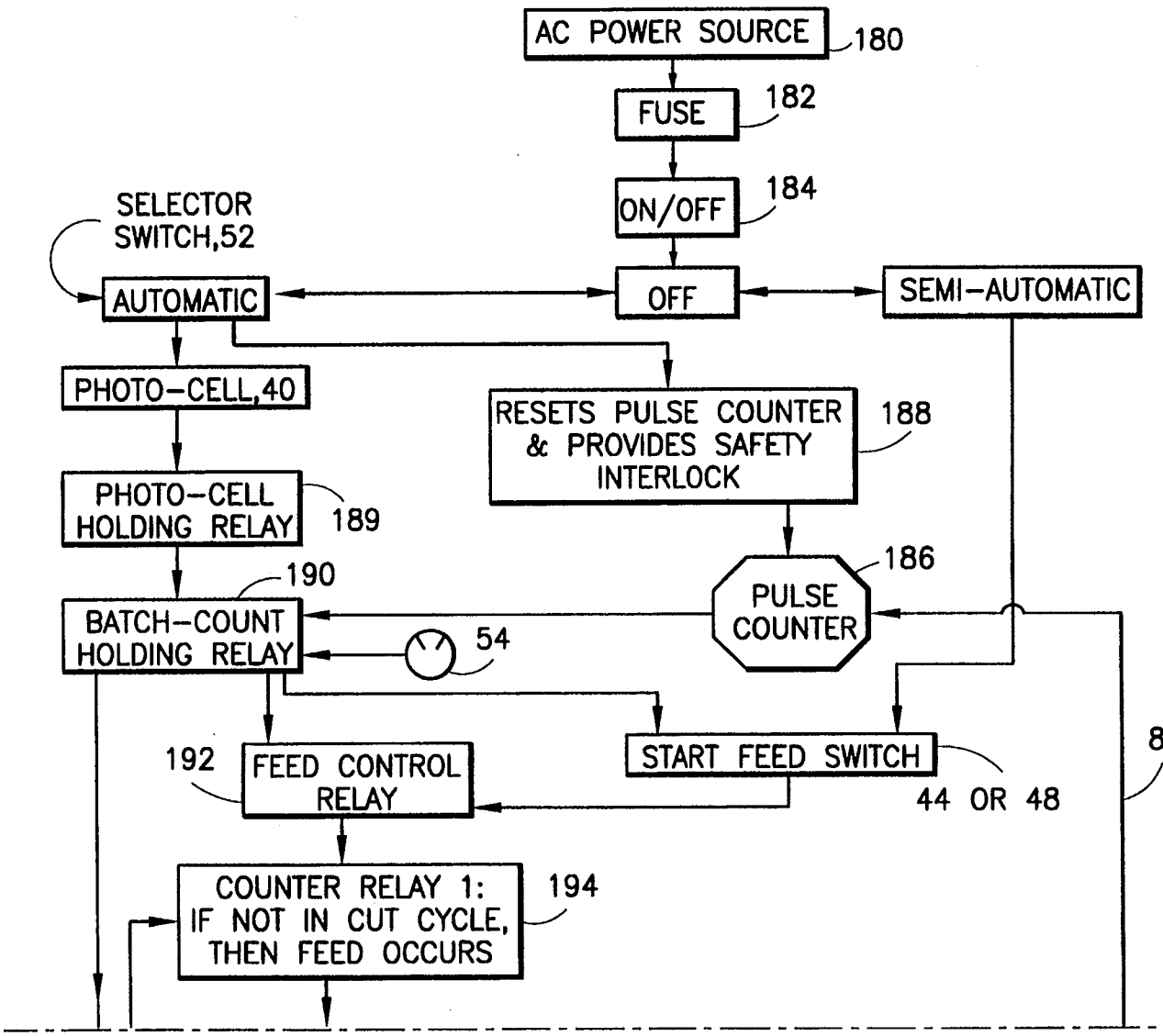
FIGS. 11A and 11B are to be considered together as one Figure showing a functional block diagram of control elements of machines embodying the present invention.
Figure 11B:
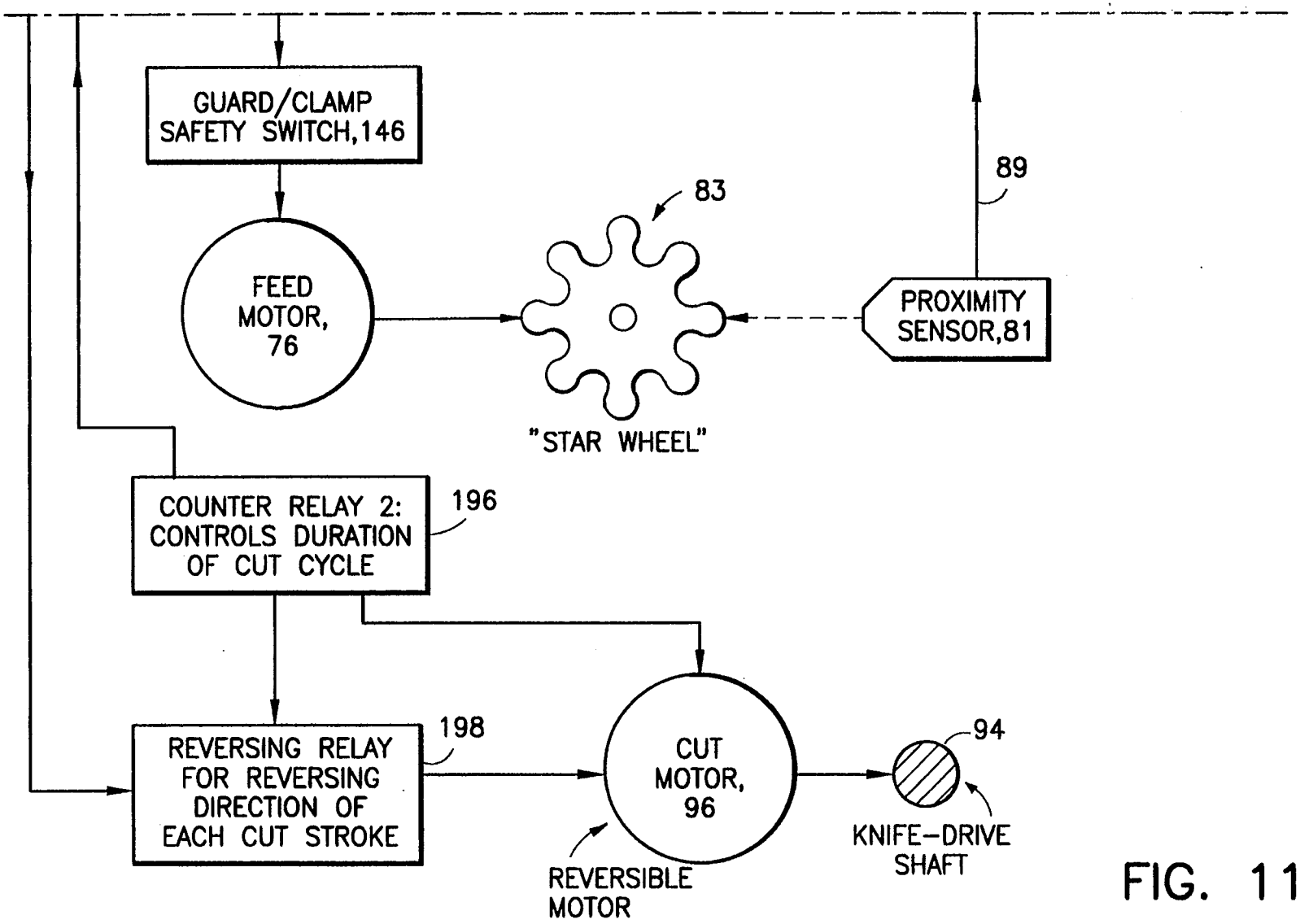

The operation of the machine 20 has been discussed at various places above. With reference to FIGS. 11A and B, this portion of the specification now will summarize some aspects of operation of the machine. Electrical power from a suitable AC source 180 feeds through a fuse 182 and through a main ON/OFF switch 184 to the selector switch 52 (FIG. 1). In center position of the selector switch knob, the machine is OFF. Turning the selected knob to the left puts the machine in "AUTOMATIC" and turning it to the right puts the machine in "SEMI-AUTOMATIC". Placing the machine in AUTOMATIC resets a pulse counter 186 and provides a safety interlock as indicated at 188.

The safety interlock function 188 operates as follows: If the selector switch 52 happens to be in its AUTOMATIC position when the main power switch 184 is turned ON, then the machine is locked in an inactive state. The operator must turn the selector switch 52 over to its OFF position and then turn it back to its AUTOMATIC position, before the AUTOMATIC functioning will become activated at the beginning of a full, normal sequence.

AUTOMATIC operation is controlled by the photo-cell 40 (FIG. 1 or 1A). As soon as each cut sheet 38 is manually removed by the operator, the photo-cell 40 automatically triggers a feed control relay 192 for causing the machine to feed out and cut off another sheet 38 of desired length.

The counter 186 may be provided by a "Durant" (Reg. TM) Ambassador Series Count Control commercially available from Eaton Corporation of Watertown, Wis. This counter 186 is associated with a batch-count holding relay 190 which is pre-set by the operator using the keypad 56. The batch count function 190 is responsive to the number of times that the counter 186 has cycled. The keypad is also used for determining two different counts for two different desired lengths of cut sheets, such as eighteen inches or fourteen inches, etc. Turning knob 54 (see also FIG. 1) to the left provides feed of a first predetermined length of cut sheet 38 and turning this knob to the right provides feed of a second predetermined length of cut sheet. As explained before, each signal from the proximity sensor 81 (FIG. 6) equals one inch of feed. After the photo-cell 40 has been actuated by removal of each cut sheet 38 (FIG. 1), thereby initiating feeding of a next length, the photo-cell is held inactive by a holding relay 189. This holding relay reactivates the photo-cell only after a desired sheet-length-count has been reached by the counter 186. When the count reaches the pre-set sheet-length-count which previously was entered, the holding relay 189 is released so that the photo-cell 40 again becomes ready to sense removal of a cut sheet 38 (FIG. 1).

As a length of web is being fed by running of feed motor 76, the proximity sensor 81 senses passing lobes of the eight-lobed disc ("star wheel") 83 (FIG. 6), wherein sensing of each lobe equals one inch of feed. The cable 89 (FIG. 6) transmits a signal from the sensor 81 to the counter 186 for each inch of feed. As explained above, when the desired count is reached (which means that the desired inches of feed length have occurred), a feed control relay 192 quickly stops the self-braking feed motor 76. As soon as the desired sheet-length-count is reached, a cutting stroke is initiated automatically.

The cover (guard/clamp) safety switch 146 (FIG. 8) prevents the feed motor 76 from operating until the operator has swung the guard/clamp down into operating position for closing the nip space "D" (FIG. 8). Since the guard/clamp safety switch 146 prevents feed power from reaching the feed motor 76 when the guard/clamp is in its open position 112" (FIG. 8) wherein the knife assembly 90 is exposed, the feed motor 76 cannot run. Thus, feed does not occur, and so the pre-set feed count does not become reached. Therefore, a cutting stroke is prevented from accidentally occurring when the guard/clamp is open, since a cutting stroke can only occur after the pre-set feed count has been reached.

A counter relay "1" is shown at 194. This counter relay at 194 permits the feed motor 76 to be energized for feeding the web in response to actuation of the photo-cell by removal of a cut sheet, unless a cut delay time period is occurring, i.e., unless cutting is occurring.

There is a counter relay "2" shown at 196 for controlling the duration of the cut cycle. As explained previously, the time period (time delay) for producing a cutting stroke 142 (FIG. 2) is a pre-set time interval, for example three seconds. Thus, the cut motor 96 rotates the knife drive shaft 94 for three seconds to produce a cut stroke. Toward the end of each cutting stroke, the cam surface 138 (FIG. 10) on the knife carriage 88 raises one of the cam-follower wheels 136 (FIG. 2) for raising the guard/clamp 112 to its feed position 112' (FIG. 5). As soon as this cut cycle duration of three seconds has occurred, the counter relay "2" at 196 actuates the counter relay "1" at 194 for permitting feed to commence as soon as the photo-cell 40 is again triggered by removal of a cut sheet 38.

There is a reversing relay 198 associated with counter relay "2" and involved with energizing the reversible cut motor 96. The reversing relay 198 causes reversal of direction of rotation of the cut motor 96 each time the cut motor is energized, thereby rotating cutter drive shaft 94 in opposite directions each running of the motor 96 for providing cutting strokes alternating in direction.

When the selector switch 52 is in its SEMI-AUTOMATIC position, the controller 42 (FIG. 1) provides continuity of one feed and cut cycle only. Thus, a feed start switch is used; for example, a foot pedal switch 44 (FIG. 1 or 1A) or a push-button panel switch 48 must be actuated by an operator for commencing a feed and cut cycle each time the operator wants a feed and cut cycle to occur for providing another cut sheet 38.

Since other changes and modifications varied to fit particular operating requirements and environments will be recognized by those skilled in the art, the invention is not considered limited to the examples chosen for purposes of illustration and includes all changes and modifications which do not constitute a departure from the true spirit and scope of this invention as claimed in the following claims and equivalents thereto.

We claim:

1. The method of feeding a web of packaging material and cutting the web into sheets of predetermined lengths comprising the steps of:

predetermining a desired length for cut sheets;
initiating feed of the web;
feeding a length of the web corresponding to said desired length;
stopping feed of the web upon reaching said desired length;
clamping the web along two spaced, parallel clamp regions extending across a width of the web;
providing a knife assembly having first and second cutting edges respectively facing in first and second directions opposite to each other, said knife assembly further having first and second cams facing in said first and second directions, respectively;
traversing the knife assembly in said first direction along an elongated traverse path extending between said two spaced, parallel clamp regions for providing a cutting stroke by said first edge across the width of the web for cutting off from the web a sheet having said desired length;
providing first and second cam-follower means near opposite ends of said traverse path;
stopping traverse of the knife assembly upon completion of a traverse of the knife assembly in said first direction;
releasing said clamping of the web after completion of said cutting stroke in said first direction by said first cam engaging said first cam-follower means;
again initiating feed of the web;
again feeding a length of the web corresponding to said desired length;
again stopping feed of the web upon reaching said desired length;
again clamping the web along said two spaced, parallel clamp regions;
traversing the knife assembly in said second direction opposite to said first direction along said traverse path for providing a cutting stroke by said second edge across the width of the web for cutting off from the web another sheet having said desired length;
again stopping traverse of the knife assembly upon completion of a traverse of the knife assembly in said second direction;
again releasing said clamping of the web after completion of said cutting stroke in said second direction.

2. The method as claimed in claim 1, comprising the further steps of:
arranging the first cutting edge facing in said first direction at an inclination relative to said cutting stroke in said first direction; and
arranging the second cutting edge facing in said second direction at an inclination relative to said cutting stroke in said second direction.

3. The method as claimed in claim 2, including the steps of:
inclining said first cutting edge facing in said first direction upwardly to a first tip;
inclining said second cutting edge facing in said second direction upwardly to a second tip; and
positioning said first and second tips adjacent one to another with said first and second cutting edges defining two sides of an isosceles triangle and with the adjacent tips being positioned at an upwardly projecting vertex of the isosceles triangle.

4. The method as claimed in claim 1, including the further step of:
frictionally propelling said traversing of the knife assembly along said traverse path in said first direction and in said second direction for enabling said traversing to become stopped in event of a substantially immovable object intruding into said traverse path in contact with the knife assembly as the knife assembly is being traversed.

5. A machine for feeding a web of packaging material and cutting the web into sheets of predetermined lengths comprising:
a bi-directional knife assembly including first and second cutting edges facing respectively in first and second directions;
reversible drive means for traversing said knife assembly alternately in said first and second directions along an elongated traverse path;
web feeding means for feeding the web longitudinally across said traverse path;
clamping means for clamping the web along two spaced clamp regions with said traverse path located between said clamp regions;
said clamp regions extending across a width of the web;
control means for stopping said web feeding means after a predetermined length of the web has been fed;
said control means also actuating said drive means and said clamping means after said predetermined length of the web has been fed for clamping the web after the predetermined length thereof has been fed and for traversing said knife assembly along said path for providing a cutting stroke extending across the width of the web between said two spaced clamp regions for cutting off from the web a sheet having the predetermined length;
reversing means for reversing said reversible drive means upon each actuation of said reversible drive means;
said machine being powered solely by electrical power;
first and second cams associated with said knife assembly;
said first cam facing in said first direction;
said second cam facing in said second direction;
first and second cam-follower means positioned near opposite ends of said traverse path;
said first cam engaging said first cam-follower means for releasing said clamping means from clamping relationship with the web after completion of a cutting stroke in said first direction and during completion of traverse in said first direction; and
said second cam engaging said second cam-follower means for releasing said clamping means from clamping relationship with the web after completion of a cutting stroke in said second direction and during completion of traverse in said second direction.

6. A machine as claimed in claim 5, further comprising:
mounting means in said knife assembly for mounting first and second blades with the first blade being provided with the first cutting edge facing in said first direction at an inclination relative to the cutting stroke in said first direction and with the second blade being provided with the second cutting edge facing in said second direction at an inclination relative to the cutting stroke in said second direction.

7. A machine as claimed in claim 6, in which:

said mounting means positions said first blade with said first cutting edge inclined upwardly to a tip of said first blade;

said mounting means positions said second blade with said second cutting edge inclined upwardly to a tip of said second blade; and said mounting means also positions said first and second tips adjacent one to another with said first and second cutting edges defining two sides of an isosceles triangle with the adjacent tips being positioned at an upwardly projecting vertex of the isosceles triangle.

8. A machine as claimed in claim 5, in which:

said first cam disengages said first cam-follower means for placing said clamping means in clamping relationship with the web during commencement of traverse in said second direction and prior to commencement of the cutting stroke in said second direction; and said second cam disengages said second cam-follower means for placing said clamping means in clamping relationship with the web during commencement of traverse in said first direction and prior to commencement of the cutting stroke in said first direction.

9. A machine as claimed in claim 8, further comprising:

mounting means associated with said knife assembly for mounting first and second blades with the first blade being provided with the first cutting edge facing in said first direction at an inclination relative to the cutting stroke in said first direction and with the second blade being provided with the second cutting edge facing in said second direction at an inclination relative to the cutting stroke in said second direction.

10. A machine as claimed in claim 9, in which:

said mounting means positions said first blade with said first cutting edge inclined upwardly to a tip of said first blade;

said mounting means positions said second blade with said second cutting edge inclined upwardly to a tip of said second blade; and said mounting means also positions said first and second tips adjacent one to another with said first and second cutting edges defining two sides of an isosceles triangle with the adjacent tips being positioned at an upwardly projecting vertex of the isosceles triangle.

11. A machine as claimed in claim 8, further comprising:

guard means associated with said clamping means; and said guard means being in guarding relation with respect to said traverse path upon said clamping means clamping the web for preventing a foreign object from intruding into the traverse path during traverse of the knife along said traverse path in either said first or second direction.

12. A machine for feeding a web of packaging material and cutting the web into sheets of predetermined lengths comprising:

a bi-directional knife assembly including first and second blades having first and second cutting edges respectively facing in first and second directions;

reversible drive means for traversing said knife assembly alternately in said first and second directions along an elongated traverse path;

web feeding means for feeding the web longitudinally across said traverse path;

clamping means for clamping the web along two spaced clamp regions with said traverse path located between said clamp regions;

said clamp regions extending across a width of the web;

control means for stopping said web feeding means after a predetermined length of the web has been fed;

said control means also actuating said drive means and said clamping means after said predetermined length of the web has been fed for clamping the web after the predetermined length thereof has been fed and for traversing said knife assembly along said path for providing a cutting stroke extending across the width of the web between said two spaced clamp regions for cutting off from the web a sheet having said the predetermined length;

reversing means for reversing said reversible drive means upon each actuation of said reversible drive means;

said machine being powered solely by electrical power;

mounting means in said knife assembly for mounting said first and second blades with the first cutting edge of said first blade facing in said first direction at an inclination relative to a cutting stroke in said first direction and with the second cutting edge of said second blade facing in said second direction at an inclination relative to a cutting stroke in said second direction;

said mounting means positioning said first blade with said first cutting edge inclined upwardly to a tip of said first blade;

said mounting means positioning said second blade with said second cutting edge inclined upwardly to a tip of said second blade;

said mounting means also positioning said first and second tips adjacent one to another with said first and second cutting edges defining two sides of an isosceles triangle with the adjacent tips being positioned at an upwardly projecting vertex of the isosceles triangle;

said mounting means further comprising:

a rear member;

said rear member including first and second upwardly inclined shoulders for positioning said first and second blades respectively with said first and second cutting edges inclined upwardly;

said rear member including first and second stops for positioning said first and second blades respectively with their first and second tips adjacent one to another;

a front clamp;

removable fastening means for removably fastening said front clamp to said rear member with said first and second blades being clamped between said front clamp and said rear member with said first and second blades being positioned therebetween by said first and second shoulders and by said first and second stops;

first and second cam means on said rear member;

said first cam means facing in said first direction and said second cam means facing in said second direction;

first and second cam-follower means positioned near opposite ends of said traverse path;

said first cam means engaging said first cam-follower means for releasing said clamping means from clamping relationship with the web after completion of the cutting stroke in said first direction and during completion of traverse in said first direction; and said second cam means engaging said second cam-follower means for releasing said clamping means from clamping relationship with the web after completion of the cutting stroke in said second direction and during completion of traverse in said second direction.

13. A machine as claimed in claim 12, in which:

said first cam means disengages from said first cam-follower means for placing said clamping means in clamping relationship with the web during commencement of traverse in said second direction and prior to commencement of the cutting stroke in said second direction; and said second cam means disengages from said second cam-follower means for placing said clamping means in clamping relationship with the web during commencement of traverse in said first direction and prior to commencement of the cutting stroke in said first direction.

14. A machine for feeding a web of packaging material and cutting the web into sheets of predetermined lengths comprising:

a bi-directional knife assembly including first and second cutting edges facing in opposite directions;

reversible drive means for traversing said knife assembly alternately in said opposite directions along an elongated traverse path;

web feeding means for feeding the web longitudinally across said traverse path;

clamping means for clamping the web along two spaced clamp regions with said traverse path located between said clamp regions;

said clamp regions extending across a width of the web;

control means for stopping said web feeding means after a predetermined length of the web has been fed;

said control means also actuating said drive means and said clamping means after said predetermined length of the web has been fed for clamping the web after the predetermined length thereof has been fed and for traversing said knife assembly along said path for providing a cutting stroke extending across the width of the web between said two spaced clamp regions for cutting off from the web a sheet having the predetermined length;

reversing means for reversing said reversible drive means upon each actuation of said drive means;

said machine being powered solely by electrical power; and said reversible drive means frictionally propelling said knife assembly in each of said first and second directions along said traverse path for allowing traverse of said knife assembly to become arrested at any time during traverse in either direction upon intrusion of a substantially unyielding foreign object into said traverse path into contact with said knife assembly for avoiding damage by said drive means to the machine.

15. A machine for feeding a web of packaging material and cutting the web into sheets of predetermined lengths comprising:

a bi-directional knife assembly including first and second cutting edges facing respectively in first and second directions;

reversible drive means for traversing said knife assembly alternately in said first and second directions along an elongated traverse path;

web feeding means for feeding the web longitudinally with the web being fed across said traverse path;

clamping means having a first position in clamping relationship with the web for clamping the web along two spaced clamp regions on opposite sides of said traverse path with said traverse path being located between said clamp regions;

said clamp regions extending across a width of the web;

said clamping means having a second position removed from clamping relationship with the web;

said knife assembly including a first cam facing in said first direction and a second cam facing in said second direction;

first and second cam followers mounted on said clamping means near opposite ends of said traverse path;

control means actuating said web feeding means upon occurrence of a predetermined condition for feeding the web and stopping said web feeding means after a predetermined length of the web has been fed across said traverse path;

said control means actuating said drive means after stopping said web feeding means for traversing said knife assembly in said first direction along said traverse path;

said second cam disengaging said second cam follower for moving said clamping means from said second position to said first position in clamping relationship with the web during commencement of traverse in said first direction and prior to commencement of a cutting stroke in said first direction;

said first cam engaging said first cam follower for moving said clamping means from said first position to said second position for releasing the web from clamping relationship after completion of the cutting stroke in said first direction and during completion of traverse in said first direction;

said control means again actuating said web feeding means upon occurrence of the predetermined condition for feeding the web and stopping said web feeding means after a predetermined length of the web has been fed across said traverse path;

said control means again actuating said drive means after stopping said web feeding means for traversing said knife assembly in said second direction along said traverse path;

said first cam disengaging said first cam follower for moving said clamping means from said second position to said first position in clamping relationship with the web during commencement of traverse in said second direction and prior to commencement of a cutting stroke in said second direction; and said second cam engaging said second cam follower for moving said clamping means from said first position to said second position for releasing the web from clamping relationship after completion of the cutting stroke in said second direction and during completion of traverse in said second direction.

16. A machine as claimed in claim 15, in which:

said web feeding means comprise two opposed feed rolls with biasing means urging said feed rolls toward each other for contacting opposite surfaces of the web between said feed rolls;

said web feeding means drives at least one of said feed rolls during feeding of the web;

said clamping means are manually movable to a third position further removed from clamping relationship with the web than said second position; and feed roll separation means associated with said clamping means overcoming said biasing means for separating said feed rolls upon moving said clamping means into said third position for facilitating manual insertion of a web between said feed rolls.

17. A machine as claimed in claim 16, in which:

said clamping means are pivotally mounted in said machine and are swingable into said first, second and third positions;

said first and second cams engage said first and second cam followers respectively for swinging said clamping means from said first position to said second position; and said first and second cams disengage said first and second cam followers respectively for swinging said clamping means from said second position to said first position.

18. A machine as claimed in claim 17, in which:

said feed roll separation means comprise cam means associated with said clamping means for overcoming said biasing means for camming said feed rolls into separated relationship upon swinging said clamping means to said third position; and safety interlock means responsive to said clamping means in said third position for preventing operation of the machine while said clamping means are in said third position.

19. A machine as claimed in claim 15, further comprising:

sensing means for sensing manual removal of a cut sheet from the machine; and said occurrence of said predetermined condition is the sensing of manual removal of a cut sheet.

20. A machine as claimed in claim 15, in which:

said reversible drive means frictionally propels said knife assembly along said traverse path in said first direction and in said second direction for allowing traverse of said knife assembly in either of said directions to become arrested upon contact by said knife assembly with an unyielding object which has inadvertently intruded into said traverse path.

21. A machine as claimed in claim 15, in which said clamping means comprise:

a pair of spaced, parallel members fastened to arms swingably mounted in the machine for swinging said parallel members toward and away from the web;

said parallel members each having clamp surfaces thereon for contacting the web in clamping relationship upon swinging the parallel members toward the web placing said clamp surfaces in contact with the web along said clamp regions; and said parallel members forming guards extending along said traverse path on opposite sides of said traverse path upon swinging said parallel members toward the web with said clamp surfaces in contact with the web for guarding the traverse path during traverse of the knife assembly along the traverse path in either said first or second direction.

22. A machine as claimed in claim 15 in which said web feeding means comprise:

first and second spaced parallel feed rolls rotatably driven in opposite rotational senses;

an idler roller extending parallel with said feed rolls;

said idler roller being rotatably mounted upon a pair of control arms located at opposite ends of said idler roller;

said control arms being pivotally mounted in the machine for selectively swinging said idler roller toward said first feed roll or toward said second feed roll;

a first web of packaging material being feedable between said idler roller and said first feed roll and a second web of packaging material being feedable between said idler roller and said second feed roll;

resilient means associated with said control arms normally biasing said idler roller toward said first feed roll for feedably engaging the first web between said idler roller and said first feed roll for selectively feeding the first web; and electrical operation means associated with said control arms for overcoming said resilient means upon actuation of said electrical operation means for swinging said idler roller toward said second feed roll for feedably engaging the second web between said idler roller and said second feed roll for selectively feeding the second web.

* * * * *